US006502809B1

(12) United States Patent
Gionta

(10) Patent No.: US 6,502,809 B1
(45) Date of Patent: Jan. 7, 2003

(54) WORKPIECE HOLDING FIXTURE

(76) Inventor: Mark S. Gionta, 85 King Arthur's Ct., Rochester, NY (US) 14626

( * ) Notice: Subject to any disclaimer, the term of this patent is extended or adjusted under 35 U.S.C. 154(b) by 0 days.

(21) Appl. No.: 09/880,967

(22) Filed: Jun. 15, 2001

(51) Int. Cl.[7] ..... B25B 1/20

(52) U.S. Cl. ..... 269/43; 269/25; 269/228; 269/154

(58) Field of Search ..... 269/43, 228, 154, 269/217, 138, 152, 910, 229, 91, 99, 75

(56) References Cited

U.S. PATENT DOCUMENTS

| | | | | | |
|---|---|---|---|---|---|
| 893,875 | A | * | 7/1908 | Schneider | 269/43 |
| 1,033,921 | A | * | 7/1912 | Morton | 269/43 |
| 1,430,226 | A | * | 9/1922 | Goodreau | 269/43 |
| 1,811,518 | A | * | 6/1931 | Palmer | 269/43 |
| 4,066,250 | A | * | 1/1978 | Campbell | 269/43 |
| 4,413,818 | A | * | 11/1983 | Lenz | 269/81 |
| 4,805,888 | A | * | 2/1989 | Bishop | 269/99 |
| 4,880,221 | A | * | 11/1989 | Richards | 269/139 |
| 5,316,277 | A | * | 5/1994 | Banks | 269/25 |
| 5,330,167 | A | * | 7/1994 | Plumb | 269/43 |
| 5,417,409 | A | * | 5/1995 | Reddell | 269/25 |

* cited by examiner

*Primary Examiner*—Joseph J. Hail, III
*Assistant Examiner*—Daniel Shanley
(74) *Attorney, Agent, or Firm*—Robert J. Bird

(57) ABSTRACT

A fixture for holding workpieces on a machine tool table includes: a base plate for placement upon table rails and slidable along such rails; a locking plate under the base plate for rotation between a locking position to secure the base plate to the table rails, and an unlocked position clear of the table rails; an upright center block on the base plate; left and right slide blocks on opposite sides of the center block, releasably clamped so as to be slidable along the base plate toward and away from the center block, each slide block including a fluid driven piston movable toward and away from the center block to releasably clamp a workpiece against it.

6 Claims, 2 Drawing Sheets

WORKPIECE HOLDING FIXTURE

BACKGROUND OF THE INVENTION

This invention is a fixture for positioning and clamping workpieces on the table of a large machine tool such as, for example, a router.

The term "fixture" is used here to mean a device for holding a workpiece during machining operations. A fixture is so called because it is fastened or fixed to a machine table or work bench. This invention is a fixture which is releasably fastenable to a machine tool table.

SUMMARY OF THE INVENTION

In summary, this invention is a fixture for holding workpieces on a machine tool table. The fixture includes: a base plate for placement upon table rails and slidable along such rails; a locking plate under the base plate for rotation between a locking position to secure the base plate to the table rails, and an unlocked position clear of this table rails; an upright center block on the base plate; left and right slide blocks on opposite sides of the center block, releasably clamped so as to be slidable along the base plate toward and away from the center block, each slide block including a fluid driven piston movable toward and away from the center block to releasably clamp a workpiece against it.

DESCRIPTION OF DRAWINGS

The drawing includes FIGS. 1–5.

DETAILED DESCRIPTION

Figure 1:
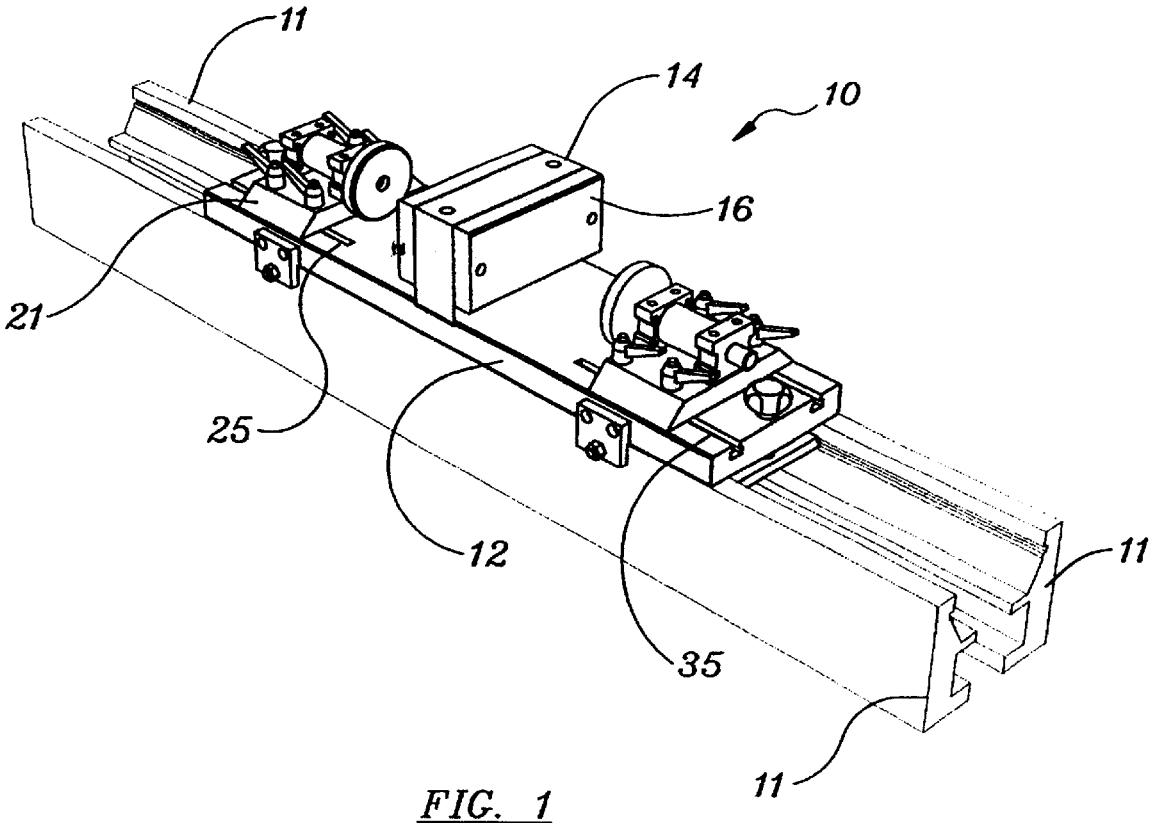
FIG. 1 is a 3-D pictorial view of my fixture, mounted on a machine tool table.
Figure 2:
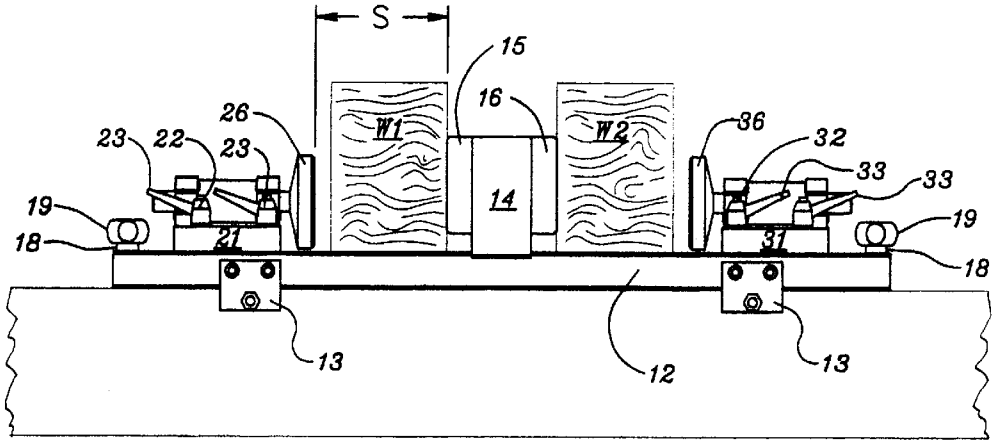
FIG. 2 is a side view of the fixture of FIG. 1, shown with workpieces in place.
Figure 3:
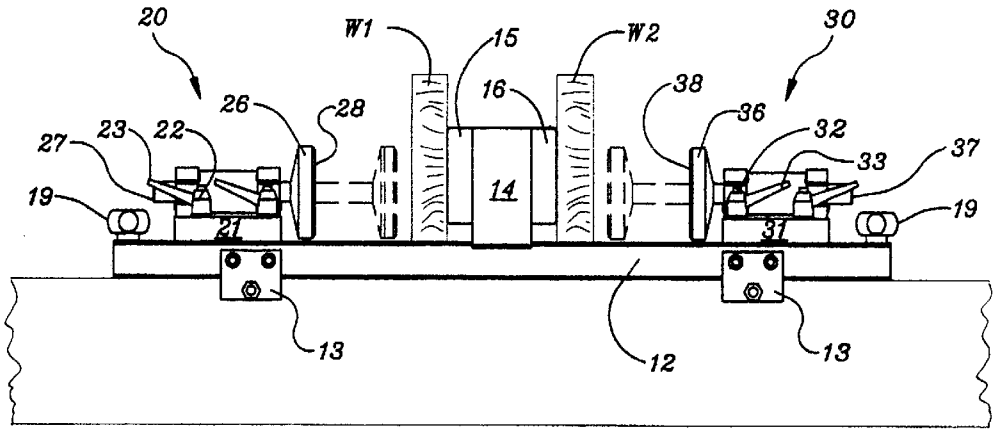
FIG. 3 is a side view, similar to FIG. 2, with thinner workpieces in place

Referring to FIGS. 1, 2, 3, a fixture 10 of this invention is mounted for sliding movement on parallel table rails 11. Only one pair of rails 11 is shown in FIG. 1. A multitude of parallel table rails 11 together form an extended area machine tool table.

The fixture 10 includes a base plate 12 mounted on, and slidable along, table rails 11. The base plate 12 includes depending flanges 13 on each side to straddle the table rails 11. An upright center block 14 mounted on the base plate includes has left and right vertical face blocks 15, 16 facing in opposite directions lengthwise of the base plate 12. The face blocks 15, 16 are removable for selective replacement by face blocks of desired material. Thus, for example, wood face blocks would be used with workpieces of wood, steel face blocks with steel workpieces, and so on.

Figure 4:
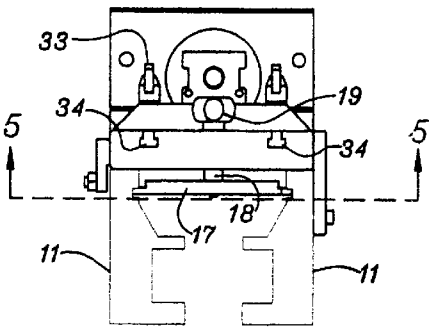
FIG. 4 is a right-end view of the fixture of FIG. 2.
Figure 5:
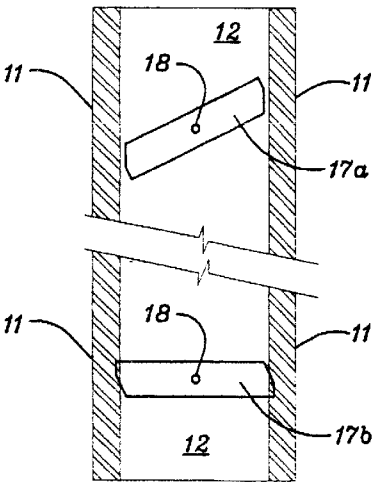
FIG. 5 is a detail view of the underside of FIG. 4.

The base plate 12 is releasably locked to table rails 11 by locking plates 17 on the underside of the base plate 12. The locking plates are located near the ends of the base plate (see FIGS. 4, 5). Each locking plate 17 is threaded on the bottom end of a screw 18 which extends vertically through the base plate 12 and includes a torque arm 19 fixed at its top end. Turning the torque arm 19 and screw 18 counterclockwise loosens the locking plate 17 so it can be turned by hand from a locking position (e.g. plate 17*a*) to an unlocked position (e.g. plate 17*b*) clear of the table rails. With plates 17 in locking position, the torque arms 19 are turned clockwise to engage and tighten the locking plates 17 against table rails 11. FIG. 4 shows a locking plate 17 in its locked position. FIG. 5 illustrates a locking plate (17*a*) in a locking position, and a locking plate (17*b*) in an unlocked position.

The fixture 10 includes left and right workpiece clamping systems 20, 30. The left clamping system 20 includes a left slide block 21 which is slidable on the base plate 12 toward and away from the center block 14. In the example shown in FIG. 1, the slide block 21 includes four clamp screws 22, each with a handle 23 at its top end and a screw head 24 at its bottom end. Each clamp screw 22 extends into a T-slot 25 in the base plate 12 (the base plate includes parallel T-slots). Clamp screws 22 are tightened to engage the T-slots 25 to thereby clamp the slide block 21 to the base plate 12. A pusher 26, mounted on the slide block 21, includes a pneumatic or hydraulic cylinder operatively connected to a source of pneumatic or hydraulic pressure (not shown). The pusher 26 includes a piston rod 27 with a face plate 28 on its outer end. The piston rod 27 is movable back and forth relative to the center block 14, to define a workpiece space S.

Similarly, the right clamping system 30 includes a right slide block 31 which is slidable on the base plate 12 toward and away from the center block 14. The slide block 31 includes clamp screws 32, each with a handle 33 and head 34, and each extending into a T-slot 35 in the base plate 12 to engage T-slots 35, to thereby clamp the slide block 31 to the base plate 12. A pusher 36 on the slide block 21 includes a pneumatic or hydraulic cylinder, and a piston rod 37 with a face plate 38 on its outer end.

In use, the fixture 10 is slid into desired position on the table rails 11, and locked there by turning (and tightening) the locking plates 17 into engagement with table rails 11, as shown in FIGS. 4, 5. Left and right slide blocks 21, 31 are then moved along the base plate 12 to positions on opposite sides of the upright center block 14 to form workpiece spaces S, and clamped there by tightening clamp screws 22, 32. The pushers 26, 36 are actuated to move toward or away from the center block 14 to releasably clamp workpieces W1, W2 against the center block. FIG. 3 shows the pusher 26, 36 in retracted positions (solid lines) and advancing toward workpieces and center block 14 (phantom lines).

The foregoing description of a preferred embodiment of this invention sets forth the best mode presently contemplated by the inventor of carrying out this invention. Any details as to materials, quantities, dimensions, and the like are intended as illustrative. The concept and scope of the invention are limited not by the description but only by the following claims and equivalents thereof.

What is claimed is:

1. A fixture for holding workpieces on a machine tool table, said fixture including:

a base plate for placement upon table rails of said table, said base plate including an upright center block and releasable locking means to lock said base plate to said table rails said locking means including a locking plate on the underside of said base plate, said locking plate rotatable in a horizontal plane between a locking position in engagement with said table rails, and an unlocked position clear of said table rails and to unlock said base plate for sliding movement along said table rails;

a slide block mounted on said base plate and slidable therealong toward and away from said center block, said slide block including releasable clamping means to clamp said slide block to said base plate and to release said slide block for sliding movement along said base plate, said clamping means including a clamp screw extending down through said slide block and said base plate, and means to tighten and loosen said screw relative to the underside of said base plate; and a fluid-operated piston mounted on said slide block for reciprocal movement toward and away from said center block said piston including a cantilevered pusher facing said center block to releasably clamp a workpiece thereagainst.

2. A fixture as defined in claim 1, further including a flat face block removably mounted on said center block for selective replacement by a face block of desired material.

3. A fixture for holding workpieces on a machine tool table, said fixture including:

a base plate for placement upon table rails of said table, said base plate including an upright center block, and an underside locking plate for rotation between a locking position to lock said base plate to said table rails and an unlocked position clear of said table rails to unlock said base plate for sliding movement along said table rails;

a slide block mounted on said base plate and slidable therealong toward and away from said base plate toward and away from said center block, said slide block including releasable clamping means to clamp said slide block to said base plate and to release said slide block for sliding movement along said base plate; and a fluid-operated piston mounted on said slide block for reciprocal movement toward and away from said center block, said piston including a cantilevered pusher facing said center block to releasably clamp a workpiece thereagainst.

4. A fixture as defined in claim 3, further including a flat face block removably mounted on said center block for selective replacement by a face block of desired material.

5. A fixture for holding workpieces on a machine tool table, said fixture including:

a base plate for placement upon table rails of said table, said base plate including an upright center block, and an underside locking plate for rotation between a locking position to lock said base plate to said table rails and an unlocked position clear of said table rails to unlock said base plate for sliding movement along said table rails;

left and right slide blocks mounted on said base plate on opposite sides of said center block and slidable along said base plate toward and away from said center block, each said slide block including releasable clamping means to clamp said slide block to said base plate and to release said slide block for sliding movement among said base plate; and a fluid-operated piston mounted on each said slide block for reciprocal movement toward and away from said center block, each said piston including a cantilevered pusher facing said center block to releasably clamp a workpiece thereagainst.

6. A fixture as defined in claim 5, further including flat face blocks removably mounted on opposite sides of said center block for selective replacement by a face block of desired material.

* * * * *